US006698872B2

(12) United States Patent
Hou et al.

(10) Patent No.: US 6,698,872 B2
(45) Date of Patent: Mar. 2, 2004

(54) INK CARTRIDGE FOR PREVENTING INK FROM SPILLING

(75) Inventors: I-Chung Hou, Hsin-Chu (TW); Chieh-Wen Wang, Hsin-Chu (TW)

(73) Assignee: International United Technology Co., Ltd., Chu-Pei (TW)

( * ) Notice: Subject to any disclaimer, the term of this patent is extended or adjusted under 35 U.S.C. 154(b) by 0 days.

(21) Appl. No.: 09/881,029

(22) Filed: Jun. 15, 2001

(65) Prior Publication Data

US 2003/0128258 A1 Jul. 10, 2003

(51) Int. Cl.[7] ..... B41J 2/175
(52) U.S. Cl. ..... 347/86
(58) Field of Search ..... 347/88, 86, 87

(56) References Cited

U.S. PATENT DOCUMENTS 5,453,771 A * 9/1995 Waseda et al. ..... 347/86
5,631,682 A * 5/1997 Takata ..... 347/86
5,671,001 A * 9/1997 Elliot et al. ..... 347/87
6,059,916 A * 5/2000 Betchon ..... 156/256
6,270,206 B1 * 8/2001 Shimizu et al. ..... 347/86
6,402,307 B1 * 6/2002 Wong et al. ..... 347/86
2002/0051043 A1 * 5/2002 Hsu et al. ..... 347/86

* cited by examiner

*Primary Examiner*—Michael Nghiem
(74) *Attorney, Agent, or Firm*—Winston Hsu

(57) ABSTRACT

An ink cartridge for an inkjet printer includes a housing, an output channel, a porous material, and an adhesive layer. The housing has a vertical ink chamber for storing ink and an opening disposed on a top side of the ink chamber for interchanging air inside the ink chamber with air outside the ink chamber. The output channel is connected with a bottom side of the ink chamber for supplying ink from the ink chamber. The porous material is filled in the ink chamber for absorbing ink within the ink chamber. The adhesive layer is formed on a top end of the porous material for forming a sealed surface on the top end of the porous material.

13 Claims, 3 Drawing Sheets

INK CARTRIDGE FOR PREVENTING INK FROM SPILLING

BACKGROUND OF THE INVENTION

1. Field of the Invention

The present invention relates to an inkjet printer, and more particularly, to an ink cartridge which can prevent ink from spilling.

2. Description of the Prior Art

A typical inkjet printer has an ink cartridge for supplying ink. For a color inkjet printer, the ink cartridge commonly has three ink chambers for storing red, green and blue ink. When printing a document, the ink stored in different ink chambers will be ejected from the ink cartridge onto the document to form various colors on the document. Moreover, the ink cartridge has an opening above each of the ink chambers so that air inside the ink chamber can be interchanged with air outside the ink chamber.

In an ink chamber, a complex pressure balancing system is required for balancing the fluid pressure since ink within the ink chamber is consumed continually. One way to store the ink includes filling a porous material in the ink chamber and balancing the pressure by using the opening above the ink chamber. U.S. Pat. No. 4,771,295 discloses such an ink chamber. However, the ink chamber has a major drawback. The porous material tends to diverse ink all over the porous material due to capillary action. Therefore, when the ink cartridge is vibrated, the ink absorbed by top portion of the porous material is likely spilled out of the ink cartridge via the opening of the ink chamber, not only spotting the document during a printing process but also mixing up the ink in other ink chambers.

SUMMARY OF THE INVENTION

It is therefore an object of the present invention to provide an ink cartridge of an inkjet printer to solve the aforementioned problems.

In accordance with the claimed invention, the ink cartridge includes a housing, an output channel, a porous material and an adhesive layer. The housing has a vertical ink chamber for storing ink and an opening disposed on a top side of the ink chamber for interchanging air inside the ink chamber with air outside the ink chamber. The output channel is connected with a bottom aide of the ink chamber for supplying ink from the ink chamber. The porous material is filled in the ink chamber for absorbing ink within the ink chamber. The adhesive layer is formed at a top end of the porous material for forming a sealed surface on the top end of the porous material.

It is an advantage of the present invention that the ink cartridge has an adhesive layer formed on the top end of the porous material. This prevents spotting of a document during a printing process and mixing up ink in other ink chambers.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 1:
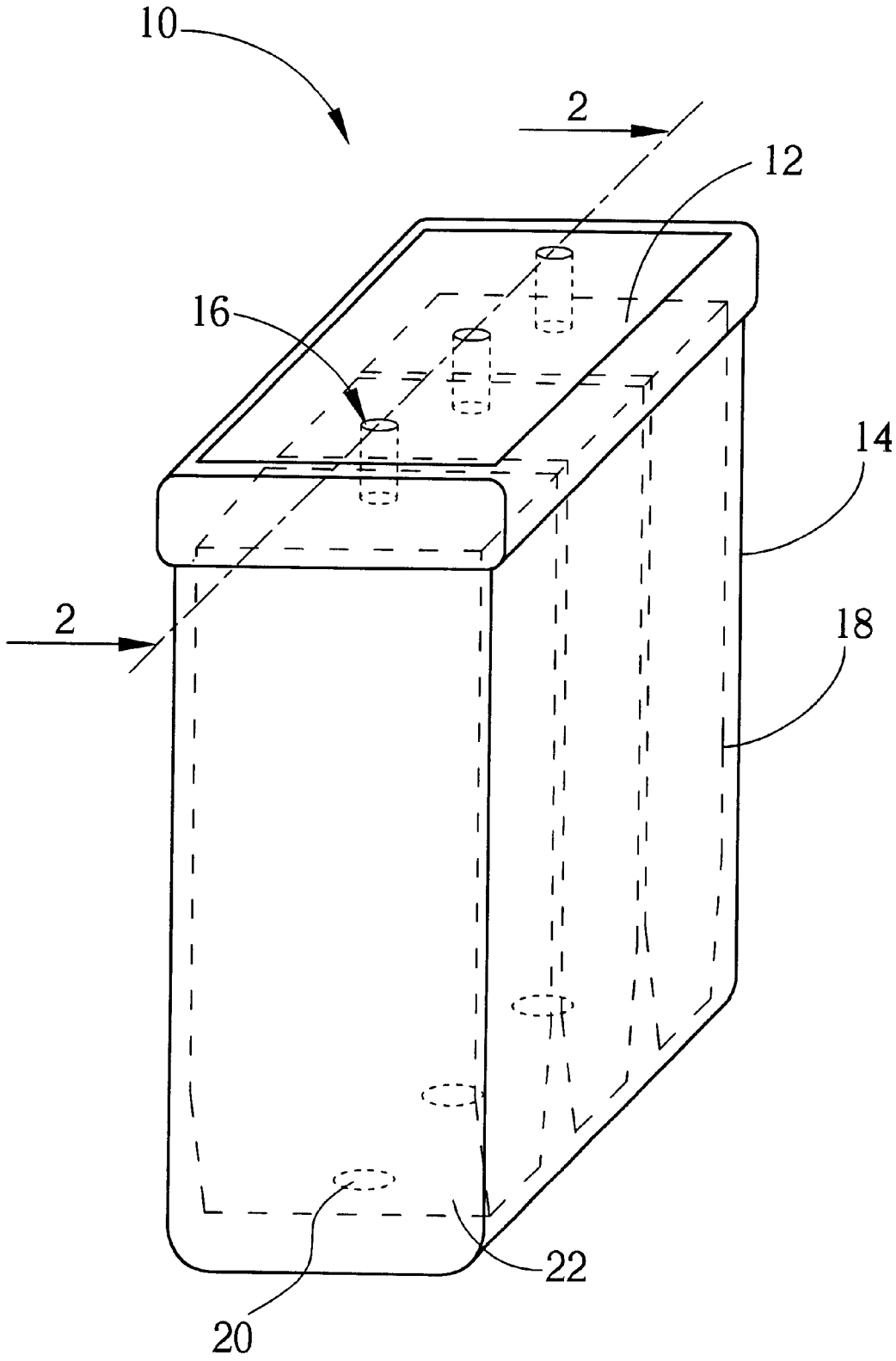
FIG. 1 is a perspective view of an ink cartridge according to the present invention.

Please refer to FIG. 1 of a perspective view of an ink cartridge 10 of the present invention. The ink cartridge 10 comprises a housing 14 having three vertical ink chambers 18 for storing ink and an opening 16 disposed on a top side 12 of each of the three ink chambers 18 for interchanging air inside the ink chambers 18 with air outside the ink chambers 18. The ink cartridge also comprises three output channels 20 each connected with a bottom side 22 of a corresponding Ink chamber 18 for supplying ink from the ink chamber 18.

Figure 2:
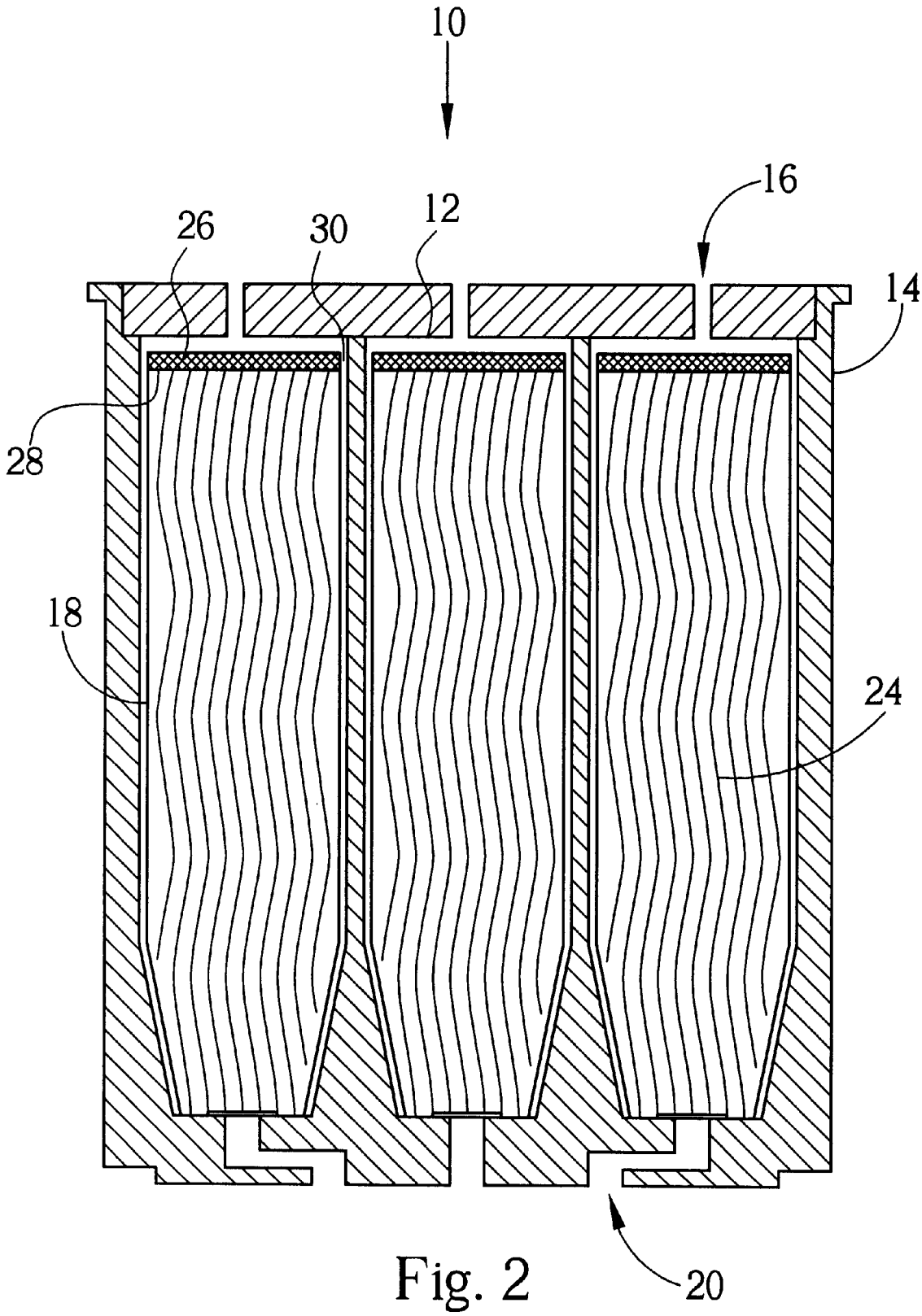
FIG. 2 is a cross-sectional view along line 2—2 of the ink cartridge in FIG. 1.

Please refer to FIG. 2 of a cross-sectional view along line 2—2 of the ink cartridge 10 in FIG. 1. The ink cartridge 10 further comprises a porous material 24 filled in each of the ink chambers 18 for absorbing ink within the ink chamber 18, and an adhesive layer 26 formed on a top end 28 of the porous material 24 for forming a sealed surface on the top end 28 of the porous material 24.

The adhesive layer 26 can be formed either by spraying an adhesive substance on the top end 28 of the porous material 24 or by fusing the top end 28 of the porous material 24. The adhesive can also be scotch tape or other means as long as the top end 28 of the porous material 24 can be sealed. After the adhesive layer 26 is formed, a gap 30 is formed around the adhesive layer 26 so that air within the ink chamber 18 can interchange with air outside of the ink chamber 18 to balance the fluid pressure in the ink chamber 18 with outside environment.

Figure 3:
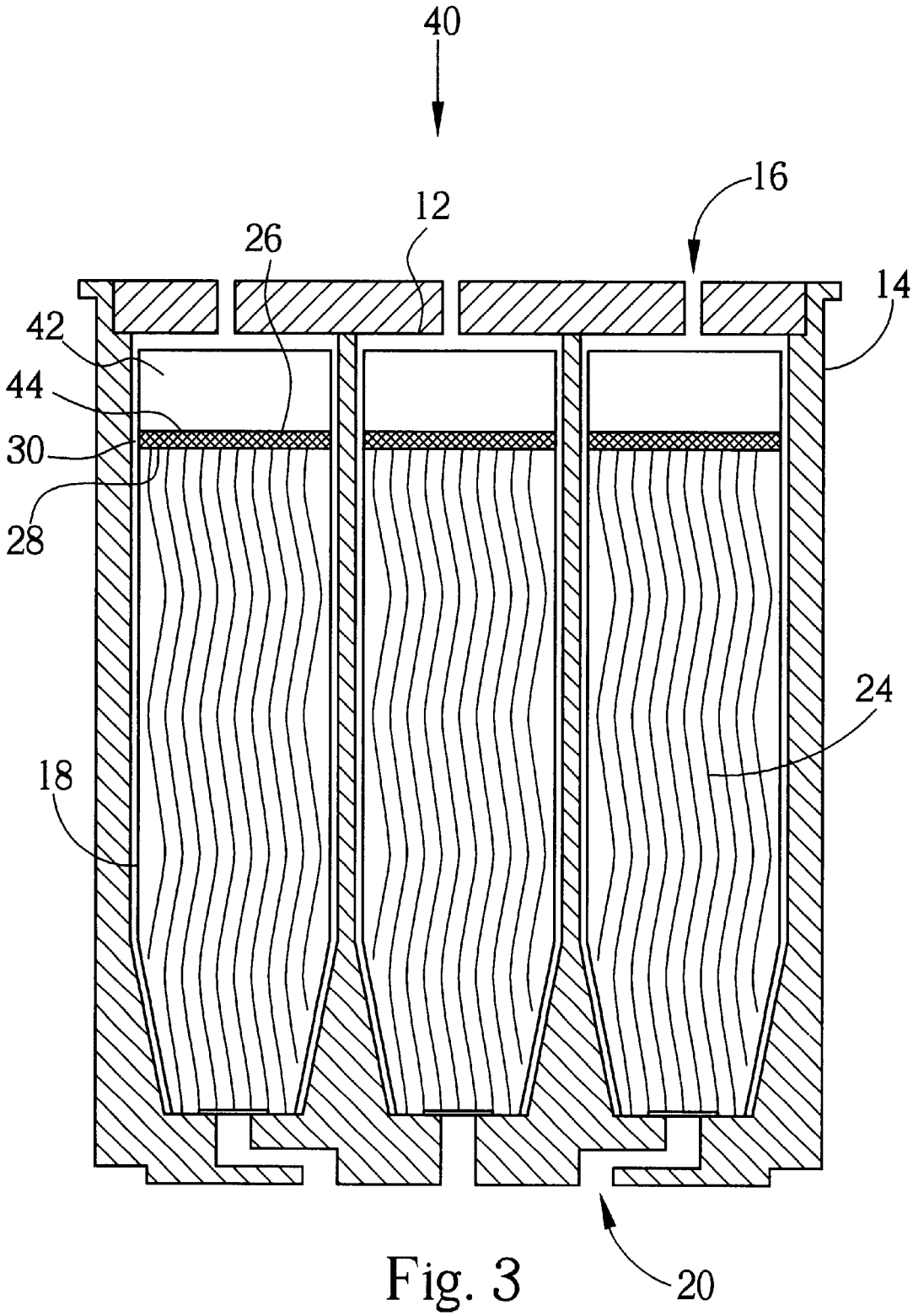
FIG. 3 shows a cross-sectional view of another ink cartridge.

Please refer to FIG. 3. FIG. 3 shows a cross-sectional view of another ink cartridge 40. The ink cartridge 40 differs from the ink cartridge 10 in that the ink cartridge 40 further comprises a filling material 42 positioned or formed above each adhesive layer 26 for preventing the ink absorbed by the porous material 24 from spilling out of the corresponding ink chamber 18. As can be seen from FIG. 2, when the ink cartridge 10 experiences an intense vibration or is upside down, the ink absorbed by the porous material 24 may leak through the gap 30 around the adhesive layer 26. Therefore, the filling material 42 in FIG. 3 can absorb the leakage to prevent ink from spilling out of the ink chamber 18 through the opening 16.

The filling material 42 can be porous to absorb ink spilled out of the porous material. Furthermore, both the porous material 24 and the filling material 42 can be sponge. However, the capillary action of the filling material 42 is less than that of the porous material 24. Thus during normal operations, the ink absorbed by the filling material 42 tends to flow downward to the porous material 24 through the gap 30 leaving little ink in the filling material 42.

In FIG. 3, each adhesive layer 26 can be formed by spraying a sticky substance such as glue only onto the top end 28 of the porous material 24 or onto both a bottom end 44 of the filling material 42 and the top end 28 of the porous material 24 to join the filling material 42 together with the porous material 24. The adhesive layer 26 can also be formed by fusing only the top end 28 of the porous material 24 or both the top end 28 of the porous material 24 and the bottom end 44 of the filling material 42. The adhesive layer 26 can further be single-sided tape stuck only onto the top end 28 of the porous material 24 or double-sided tape stuck to both the top end 28 of the porous material 24 and the bottom end 44 of the filling material 42.

Compared with prior art, the ink cartridge 10, 40 has an adhesive layer 26 formed on the top end 28 of the porous material 24. The adhesive layer 26 forms a sealed surface on the top end 28 of the porous material 24 so that ink absorbed by the porous materials 24 cannot spill out of the ink chambers 18 easily. This prevents spotting of a document during a printing process and mixing up ink in other ink chambers 18.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink cartridge for an inkjet printer comprising:

a housing having a vertical ink chamber for storing ink and an opening disposed on a top side of the ink chamber for interchanging air inside the ink chamber with air outside the ink chamber;

an output channel connected with a bottom side of the ink chamber for supplying ink from the ink chamber;

a porous material filled in the ink chamber for absorbing ink within the ink chamber;

an adhesive layer formed on a top end of the porous material for forming a sealed surface on the top end of the porous material; and a filling material positioned above the adhesive layer for preventing the ink absorbed by the porous material from spilling out of the ink chamber.

2. The ink cartridge of claim 1 wherein the adhesive layer is formed by spraying an adhesive substance on the top end of the porous material.

3. The ink cartridge of claim 1 wherein the adhesive layer is formed by fusing the top end of the porous material.

4. The ink cartridge of claim 1 wherein the adhesive layer is scotch tape for sealing the top end of the porous material.

5. The ink cartridge of claim 1 wherein the adhesive layer is formed by spraying a sticky substance to join a bottom end of the filling material together with the top end of the porous material.

6. The ink cartridge of claim 1 wherein the adhesive layer is formed by fusing both the top end of the porous material and the bottom end of the filling material.

7. The ink cartridge of claim 1 wherein the adhesive layer is double-sided tape stuck to the top end of the porous material and a bottom end of the filling material.

8. The ink cartridge of claim 1 wherein the filling material is porous for absorbing ink spilled out of the porous material.

9. The ink cartridge of claim 1 wherein the porous material is sponge.

10. The ink cartridge of claim 1 wherein the filling material is sponge.

11. The ink cartridge of claim 1 wherein capillary action of the filling material is less than capillary action of the porous material.

12. An ink cartridge for an inkjet printer comprising:

a housing having a vertical ink chamber for storing ink and an opening disposed on a top side of the ink chamber for interchanging air inside the ink chamber with air outside the ink chamber;

an output channel connected with a bottom side of the ink chamber for supplying ink from the ink chamber;

a porous material filled in the ink chamber for absorbing ink within the ink chamber; and an adhesive layer formed on a top end of the porous material for forming a sealed surface on the top end of the porous material;

wherein the adhesive layer is scotch tape for sealing the top end of the porous material.

13. The ink cartridge of claim 12 wherein the porous material is sponge.

* * * * *